US011136980B2

(12) United States Patent
Shimizu

(10) Patent No.: US 11,136,980 B2
(45) Date of Patent: Oct. 5, 2021

(54) COMPRESSOR

(71) Applicant: DAIKIN INDUSTRIES, LTD., Osaka (JP)

(72) Inventor: Takashi Shimizu, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 173 days.

(21) Appl. No.: 16/477,043

(22) PCT Filed: Feb. 9, 2018

(86) PCT No.: PCT/JP2018/004687
§ 371 (c)(1),
(2) Date: Jul. 10, 2019

(87) PCT Pub. No.: WO2018/147430
PCT Pub. Date: Aug. 16, 2018

(65) Prior Publication Data

US 2019/0338788 A1 Nov. 7, 2019

(30) Foreign Application Priority Data

Feb. 9, 2017 (JP) ..... JP2017-021963

(51) Int. Cl.
*F04C 29/02* (2006.01)
*F04B 39/00* (2006.01)
(Continued)

(52) U.S. Cl.
CPC ..... *F04C 29/026* (2013.01); *F04B 39/0027* (2013.01); *F04B 39/0066* (2013.01);
(Continued)

(58) Field of Classification Search
CPC ..... F04B 39/0027; F04B 39/0066; F04B 39/0238; F04B 39/04; F04B 39/02–0207;
(Continued)

(56) References Cited

U.S. PATENT DOCUMENTS 1,967,033 A * 7/1934 Lipman ..... F25B 31/026 62/469
1,967,034 A * 7/1934 Lipman ..... F25B 1/04 417/372
(Continued)

FOREIGN PATENT DOCUMENTS

CN 103782033 A 5/2014
CN 106151042 A 11/2016
(Continued)

OTHER PUBLICATIONS

International Search Report of corresponding PCT Application No. PCT/JP2018/004687 dated Apr. 10, 2018.
(Continued)

*Primary Examiner* — Alexander B Comley
(74) *Attorney, Agent, or Firm* — Global IP Counselors, LLP

(57) ABSTRACT

A compressor includes a compression mechanism to compress gas and discharge compressed gas, an electric motor to drive the compression mechanism, a casing housing the compression mechanism and the electric motor, a suction pipe connected to a suction side of the compression mechanism via the casing, and a discharge pipe provided at the casing to open in a space in the casing. The space has a first space located below the motor, and a second space located above the motor. The compression mechanism is disposed in the first space. The compressor is provided with a partition plate disposed in the second space, and the having a gas passage hole. The partition plate further has an oil drain hole formed at a lower level than an open end of the gas passage hole, and located radially outside an outer peripheral surface of a rotor of the electric motor.

16 Claims, 10 Drawing Sheets

(51) Int. Cl.
*F04C 29/06* (2006.01)
*F04B 39/02* (2006.01)
*F04B 39/04* (2006.01)

(52) U.S. Cl.
CPC ..... *F04B 39/0238* (2013.01); *F04B 39/04* (2013.01); *F04C 29/061* (2013.01); *F04C 29/065* (2013.01)

(58) Field of Classification Search
CPC ..... F04B 39/023–0253; F04B 53/18; F04C 29/026; F04C 29/061; F04C 29/065; F04C 29/02–028
USPC ... 417/410.3, 423.13, 410.4–410.5, 366, 372
See application file for complete search history.

(56) References Cited

U.S. PATENT DOCUMENTS 3,169,696 A * 2/1965 Warner ..... F04C 29/02 417/372
4,717,316 A * 1/1988 Muramatsu ..... F04C 29/026 417/372
4,995,789 A * 2/1991 Fujio ..... F04C 23/008 417/360
5,087,170 A * 2/1992 Kousokabe ..... F25B 31/002 415/110
5,421,708 A * 6/1995 Utter ..... F04C 28/28 418/2
5,683,236 A * 11/1997 Harrison ..... F04C 28/28 137/513.3
7,563,084 B2 * 7/2009 Kurita ..... F04C 18/322 418/29
7,704,059 B2 * 4/2010 Tamaoki ..... F04C 29/026 418/11
7,789,202 B2 * 9/2010 Lee ..... F04C 23/008 184/6.2
8,430,648 B2 * 4/2013 Kanayama ..... F04C 23/008 417/312
8,801,397 B2 * 8/2014 Okaichi ..... F04C 29/023 417/366
9,039,388 B2 * 5/2015 An ..... F04C 23/008 417/321
9,702,363 B2 * 7/2017 Higuchi ..... F01C 21/02
2012/0174620 A1 * 7/2012 Takashima ..... F04C 29/0021 62/498
2013/0219952 A1 * 8/2013 Takashima ..... F04B 39/14 62/498
2015/0244238 A1 * 8/2015 Tanaka ..... H02K 7/04 417/410.3
2017/0306964 A1 * 10/2017 Kim ..... F04C 29/0085

FOREIGN PATENT DOCUMENTS

JP 48-73808 U 9/1973
JP 60-69296 A 4/1985
JP 02081972 A * 3/1990
JP 2007-23822 A 2/2007
JP 2007023822 A * 2/2007 ..... F04B 39/0055

OTHER PUBLICATIONS

European Search Report of corresponding EP Application No. 18 75 1631.5 dated May 6, 2020.
International Preliminary Report of corresponding PCT Application No. PCT/JP2018/004687 dated Aug. 22, 2019.

* cited by examiner

COMPRESSOR

CROSS-REFERENCE TO RELATED APPLICATIONS

This U.S. National stage application claims priority under 35 U.S.C. § 119(a) to Japanese Patent Application No. 2017-021963, filed in Japan on Feb. 9, 2017, the entire contents of which are hereby incorporated herein by reference.

TECHNICAL FIELD

The present disclosure relates to a compressor, and more particularly to a compressor having a partition plate intended to reduce the generation of a standing wave due to a low frequency component in a casing to reduce pressure pulsation.

BACKGROUND ART

A compressor has been known in which a compression mechanism and an electric motor are housed in a casing, and the compression mechanism is disposed below the electric motor (see, for example, Japanese Unexamined Patent Publication No. 2007-023822). In the compressor of Japanese Unexamined Patent Publication No. 2007-023822, a high-pressure refrigerant compressed in the compression mechanism fills the casing, and then flows out of the compressor through a discharge pipe provided at the top of the casing. In the compressor of Japanese Unexamined Patent Publication No. 2007-023822, a space below the electric motor is defined as a first space, a space above the electric motor is defined as a second space, and a partition plate having a noise reduction opening formed in a center portion thereof is provided in the second space. The partition plate serves to reduce the generation of a standing wave. The standing wave is generated by a pressure wave, of a low frequency component, which is contained in a discharge gas discharged from the compression mechanism and which travels from the first space to the second space, and by the reflection of the pressure wave reflected on an upper end plate of the compressor and returns to the first space.

SUMMARY

However, in the compressor of Japanese Unexamined Patent Publication No. 2007-023822, lubricant contained in the discharged gas is separated from the refrigerant in the space above the partition plate, and tends to accumulate on the surface of the partition plate. The lubricant accumulated on the upper surface of the partition plate falls downward through the opening formed in the center portion of the partition plate. The lubricant that has fallen off the partition plate turns to droplets as it collides against a rotating rotor, and the droplets are blown toward the periphery by a swirling flow and atomized as they collide against a coil of a stator or a wall surface of the casing. The atomized lubricant floats in the space inside the compressor, and is easily emitted to the outside while being contained in the discharged gas.

If a large amount of the lubricant is emitted outside the compressor in this manner, an oil level in the compressor is lowered, which increases the possibility of poor lubrication in sliding portions due to lack of the lubricant fed from an oil pump at the lower end of a drive shaft connected to the electric motor and the compression mechanism. Further, if the lubricant discharged outside the compressor flows into a heat exchanger of a refrigerant circuit and adheres to an inner surface of the heat exchanger, the heat exchange performance is impaired.

In view of the foregoing, the present disclosure is directed to a compressor having a partition plate for reducing pressure pulsation in a casing, and intends to reduce the discharge of a lubricant together with a refrigerant from the compressor to the outside of the compressor, thereby reducing the possibilities of poor lubrication in the compressor and the impairment of the performance of a refrigerant circuit connected to the compressor.

Solution to the Problem

A first aspect of the present disclosure is directed to a compressor including: a compression mechanism (20) which compresses gas and discharges the compressed gas; an electric motor (30) which drives the compression mechanism (20); a casing (10) which houses the compression mechanism (20) and the electric motor (30); a suction pipe (14) connected to a suction side of the compression mechanism (20) via the casing (10); and a discharge pipe (15) provided at the casing (10) so as to open in a space in the casing (10), the space in the casing (10) having a first space (S1) located below the electric motor (30) and a second space (S2) located above the electric motor (30), the compression mechanism (20) being disposed in the first space (S2), and the compressor being provided with a partition plate (50) disposed in the second space (S2) and having a gas passage hole (51) formed therein.

The partition plate (50) has an oil drain hole (53) formed at a lower level than an open end of the gas passage hole (51), and located radially outside an outer peripheral surface of a rotor (32) of the electric motor (30).

In the first aspect, a high pressure gas discharged from the compression mechanism (20) disposed in the first space (S1) passes through the gap in the electric motor (30), flows into the second space (S2), passes through the gas passage hole (51) formed in the partition plate (50) disposed in the second space (S2), and then flows outside the compressor through the discharge pipe (15). In this aspect, the oil drain hole (53) is formed in the peripheral portion of the partition plate (50) to be located at a lower level than the open end of the gas passage hole (51). Thus, the lubricant separated from the refrigerant above the partition plate (50) drops downward through the oil drain hole (53). The lubricant falls off the partition plate (50) not through the center portion of the partition plate (50), but via the oil drain hole (53) cut in the peripheral portion of the partition plate (50). This feature reduces the possibility that the lubricant is atomized by the rotation of the rotor of the electric motor (30). Therefore, the lubricant is less likely to flow outside the compressor, but is accumulated in the bottom of the casing (10) of the compressor. This can curb the lowering of the oil level. Further, pressure pulsation is reduced by the action of the partition plate (50).

A second aspect is an embodiment of the first aspect. In the second aspect, a discharge muffler (44) having a discharge opening (44*a*) is attached to the compression mechanism (20), and $A2<A<A1$ is satisfied where A represents a total area of the gas passage hole (51) and the oil drain hole (53), A1 represents an area of the discharge opening (44*a*) of the discharge muffler (44), and A2 represents an area of an inlet of the discharge pipe (15).

In the second aspect, $A2<A<A1$ is satisfied. With the decrease in the opening area A of the partition plate (50), the pulsation is further reduced, but simultaneously, the pressure loss increases, and the efficiency decreases. However, in this aspect, the pulsation can be reduced while the pressure loss is kept from increasing.

A third aspect is an embodiment of the first or second aspect. In the third aspect, the partition plate (50) has a raised portion (54) formed on a peripheral portion of the gas passage hole (51).

A fourth aspect is an embodiment of any one of the first to third aspects. In the fourth aspect, an insertion pipe (55) is provided in the gas passage hole (51).

In the third and fourth aspects, the raised portion (54) provided at the partition plate (50) and the insertion pipe (55) function as a tail pipe. This feature can reduce the pulsation of the high pressure gas refrigerant discharged from the compression mechanism (20) with the help of the effect of resonance caused when the high pressure refrigerant gas passes through the raised portion (54) and the insertion pipe (55) serving as the tail pipe.

A fifth aspect is an embodiment of any one of the first to fourth aspects. In the fifth aspect, the open end of the gas passage hole (51) and a lower end of the discharge pipe (15) face each other with a predetermined gap (G) interposed therebetween, and the gap (G) between the open end of the gas passage hole (51) and the lower end of the discharge pipe (15) and a space around the gap (G) constitute a Helmholtz muffler.

In the fifth aspect, the pressure pulsation is reduced by the Helmholtz muffler formed by the gap (G) between the open end of the gas passage hole (51) and the lower end of the discharge pipe (15) and the space around the gap (G).

A sixth aspect is an embodiment of any one of the first to fifth aspects. In the sixth aspect, a power supply wire (18) connected to a terminal (17) provided on a top of the casing (10) and the electric motor (30) passes through the oil drain hole (53).

In the sixth aspect, the wire (18) passes through the oil drain hole (53) cut in the peripheral portion of the partition plate (50). Thus, the lubricant adhering to the wire (18) does not flow toward the rotor in the center portion of the electric motor (30). This feature reduces the possibility that the lubricant is atomized by the rotation of the rotor.

A seventh aspect is an embodiment of any one of the first to sixth aspects. In the seventh aspect, a center of the gas passage hole (51) and a center of the discharge pipe (15) are out of alignment with each other.

In the seventh aspect, the center of the gas passage hole (51) and the center of the discharge pipe (15) are out of alignment with each other. This feature makes it less likely that the lubricant flows outside the compressor.

An eighth aspect is an embodiment of any one of the first to seventh aspects. In the eighth aspect, the discharge pipe (15) vertically penetrates an upper end plate (12) of the casing (10) which is in a shape of a vertically-oriented cylinder.

A ninth aspect is an embodiment of any one of the first to sixth aspects. In the ninth aspect, the discharge pipe (15) laterally penetrates a barrel (11) of the casing (10) which is in a shape of a vertically-oriented cylinder.

In the eighth aspect, the lubricant is less likely to flow upward to the outside of the casing (10) through the discharge pipe (15). In the ninth aspect, the lubricant is less likely to flow in the lateral direction to the outside of the casing (10) through the discharge pipe (15).

According to the present disclosure, the emission of the lubricant to the outside of the compressor is reduced, and the oil level in the compressor is less likely to be lowered. This feature reduces the possibility of lack of the lubricant fed from the oil pump at the lower end of the drive shaft connected to the electric motor (30) and the compression mechanism (20), and reduces the possibility of the poor lubrication in the sliding portions. Further, since the lubricant is less likely to flow outside the compressor, the lubricant can be kept from flowing into the heat exchanger of the refrigerant circuit and adhering to the inner surface of the heat exchanger. This can reduce the impairment of the heat exchange performance. In addition, provision of the partition plate (50) reduces the vibration and noise caused by the pressure pulsation.

According to the second aspect, $A2<A<A1$ is satisfied. With the decrease in the opening area A of the partition plate (50), the pulsation is further reduced, but simultaneously, the pressure loss increases, and the efficiency decreases. However, in this aspect, the pressure pulsation can be reduced while the pressure loss is kept from increasing.

According to the third and fourth aspects, the raised portion (54) provided at the partition plate (50) and the insertion pipe (55) function as the tail pipe. This feature can reduce noise generated by the pulsation of the high pressure refrigerant gas discharged from the compression mechanism (20) with the help of the effect of resonance caused when the high pressure refrigerant gas passes through the raised portion (54) and the insertion pipe (55) serving as the tail pipe, thereby enabling reduction of the vibration and the noise.

According to the fifth aspect, the pulsation can be reduced more effectively by a Helmholtz muffler formed by the gap (G) between the open end of the gas passage hole (51) and the lower end of the discharge pipe (15) and the space around the gap (G).

According to the sixth aspect, the wire (18) passes through the oil drain hole (53) cut in the peripheral portion of the partition plate (50). Thus, the lubricant adhering to the wire (18) is less likely to flow toward the rotor in the center portion of the electric motor (30). Therefore, the lubricant is less likely to be atomized by the rotation of the rotor. This feature reduces the possibility that the lubricant flows outside the compressor, thereby curbing the lowering of the oil level. Since the wire (18) passes through the oil drain hole (53), the length of the wire (18) connected to the terminal (17) provided at the casing (10) and the electric motor (30) can be made shorter than that in the case where the wire does not pass through the oil drain hole (53). This can save the material.

According to the seventh aspect, the center of the gas passage hole (51) and the center of the discharge pipe (15) are out of alignment with each other. This feature reduces the possibilities that the lubricant flows outside the compressor and that the oil level is lowered. As a result, problems such as poor lubrication are less likely to occur.

The eighth and ninth aspects make it less likely that the lubricant flows outside the compressor, regardless of the direction of the discharge pipe (15). Thus, the problems such as poor lubrication are less likely to occur. In particular, the configuration according to the ninth aspect in which the discharge pipe (15) laterally penetrates the casing (10) is relatively frequently adopted to a compressor using carbon dioxide as the refrigerant (a compressor whose casing (10) has a higher internal pressure than a compressor using a general refrigerant). Therefore, this configuration is significantly effective in reducing the occurrence of poor lubrication in such a compressor using a high pressure refrigerant.

DETAILED DESCRIPTION OF EMBODIMENT(S)

Embodiments of the present invention will be described in detail below with reference to the accompanying drawings.

First Embodiment

A first embodiment will be described below.

Figure 1:
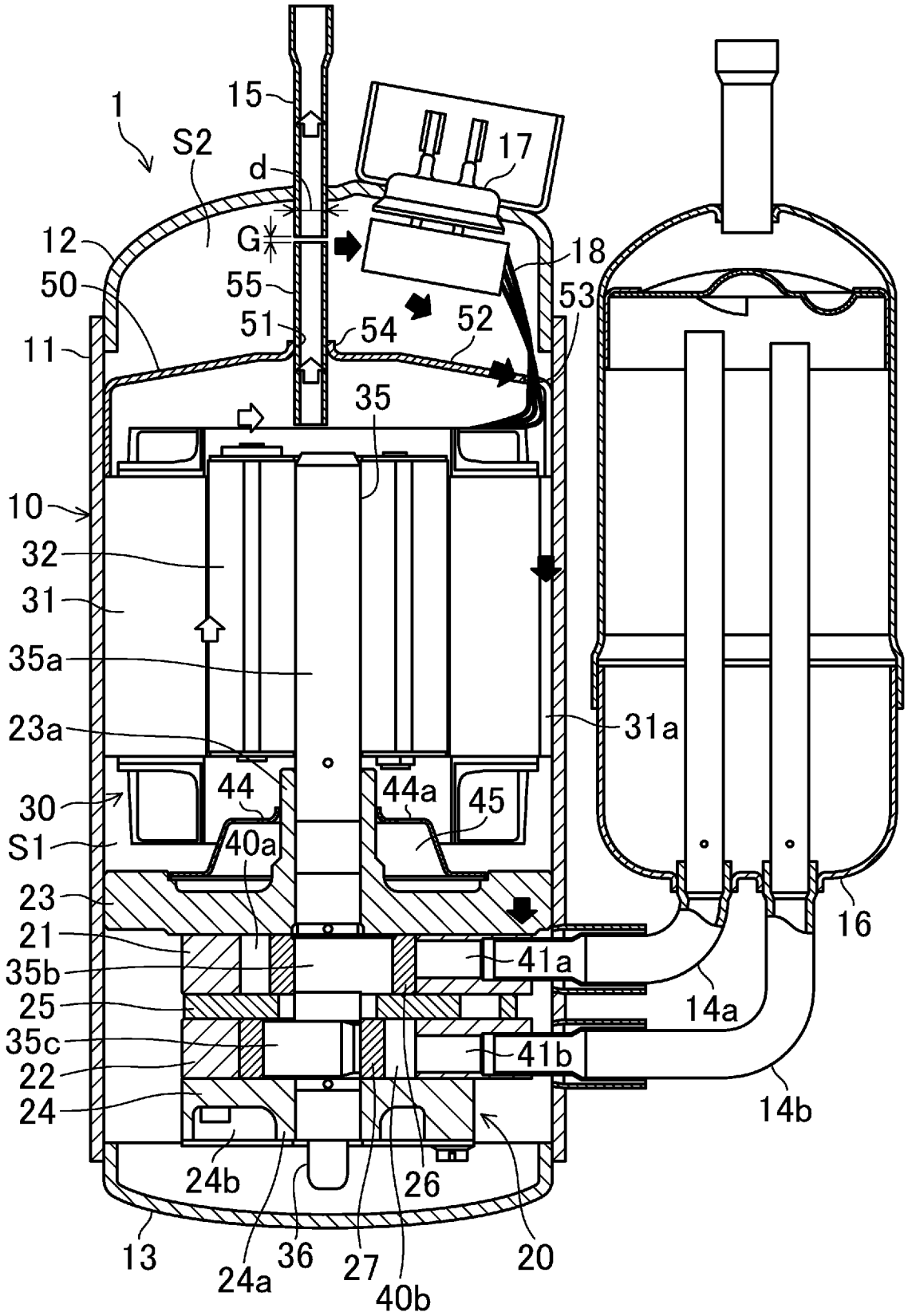
FIG. 1 is a longitudinal sectional view of a compressor according to an embodiment.

FIG. 1 is a longitudinal sectional view of a compressor (1) according to the first embodiment. The compressor (1) is a swing piston compressor, and is connected to a refrigerant circuit (not shown) for performing a refrigeration cycle.

The compressor (1) includes a casing (10), in which a compression mechanism (20) for compressing a refrigerant in the refrigerant circuit and an electric motor (30) for driving the compression mechanism (20) are housed.

The casing (10) is a closed container in the shape of a vertically-oriented cylinder, and has a cylindrical barrel (11), an upper end plate (12) which covers an upper opening of the barrel (11), and a lower end plate (13) which covers a lower opening of the barrel (11).

The compression mechanism (20) and the electric motor (30) are fixed to an inner peripheral surface of the barrel (11).

The electric motor (30) includes a stator (31) and a rotor (32), both of which are formed in a cylindrical shape. The stator (31) is fixed to the barrel (11) of the casing (10). The rotor (32) is disposed in a hollow portion of the stator (31). In the hollow portion of the rotor (32), a drive shaft (35) is fixed to pass through the rotor (32) so that the rotor (32) and the drive shaft (35) are integrally rotated.

The drive shaft (35) has a vertically extending main shaft (35*a*). A first eccentric portion (35*b*) and a second eccentric portion (35*c*) are formed integrally with a portion of the main shaft (35*a*), the portion being near a lower end of the main shaft (35*a*). The first eccentric portion (35*b*) is located above the second eccentric portion (35*c*). The first eccentric portion (35*b*) and the second eccentric portion (35*c*) are formed to have a larger diameter than the main shaft (35*a*), and have axial centers decentered by a predetermined distance with respect to the axis of the main shaft (35*a*). The first eccentric portion (35*b*) and the second eccentric portion (35*c*) are respectively decentered in directions different from each other by 180°.

A centrifugal pump (36) is provided at the lower end of the main shaft (35*a*). The centrifugal pump (36) is immersed in a lubricant in an oil reservoir formed at the bottom of the casing (10). The centrifugal pump (36) supplies the lubricant to sliding portions of the compression mechanism (20) through a lubricant supply path (not shown) inside the drive shaft (35) along with the rotation of the drive shaft (35).

The compression mechanism (20) is a two-cylinder compression mechanism.

The compression mechanism (20) includes a first cylinder (21) and a second cylinder (22), each of which is formed in an annular shape, a front head (23) fixed to an end (upper end) of the first cylinder (21) on one side in the axial direction, a rear head (24) fixed to an end (lower end) of the second cylinder (22) on the other side in the axial direction, and a middle plate (25) fixed between the first cylinder (21) and the second cylinder (22). The front head (23), the first cylinder (21), the middle plate (25), the second cylinder (22), and the rear head (24) are stacked in this order from top to bottom, and are fastened by fastening members such as bolts (not shown).

The drive shaft (35) vertically penetrates the compression mechanism (20). The front head (23) and the rear head (24) are respectively provided with bearings (23*a*, 24*a*) supporting the drive shaft (35) above the first eccentric portion (35*b*) and below the second eccentric portion (35*c*).

A first cylinder chamber (40*a*) is formed in the first cylinder (21), and a second cylinder chamber (40*b*) is formed in the second cylinder (22). The first cylinder chamber (40*a*) houses a first piston (26) externally fitted to the first eccentric portion (35*b*) of the drive shaft (35) in a slidable manner so as to make eccentric rotation in the first cylinder chamber (40*a*). The second cylinder chamber (40*b*) houses a second piston (27) externally fitted to the second eccentric portion (35*c*) of the drive shaft (35) in a slidable manner so as to make eccentric rotation in the second cylinder chamber (40*b*).

Although not shown in detail, each of the pistons (26, 27) is provided with an integral blade which extends radially outward from an outer peripheral surface of its annular body to partition the corresponding cylinder chamber (40*a*, 40*b*) into a high pressure space and a low pressure space. The blades are swingably held in the corresponding cylinder (21, 22) via a swing bush (not shown).

Each of the cylinders (21, 22) is provided with a suction port (41*a*, 41*b*) communicating with the low pressure space of the corresponding cylinder chamber (40*a*, 40*b*).

The front head (23) is provided with a discharge port (not shown) extending parallel to the axis of the drive shaft (35) and communicating with the high pressure space of the first cylinder chamber (40*a*). The discharge port is opened and closed by a discharge valve (not shown).

A muffler (44) is attached to an upper surface of the front head (23) so as to cover the discharge port and the discharge valve. A muffler space (45) is formed inside the muffler (44). The muffler space (45) communicates with the internal space of the casing (10) through discharge openings (44*a*) formed in the top of the muffler.

The rear head (24) is provided with a discharge port (not shown) which allows the high pressure space of the second cylinder chamber (40*b*) to communicate with a discharge space (24*b*). The discharge space (24*b*) of the rear head (24) communicates with the muffler space (45) in the muffler (44) through communication holes (not shown) formed in the rear head (24), the second cylinder (22), the middle plate (25), the first cylinder (21), and the front head (23).

As shown in FIG. 1, suction pipes (14*a*, 14*b*) respectively connected to the suction ports (41*a*, 41*b*) are attached to the casing (10). Each of the suction pipes (14*a*, 14*b*) is connected to an accumulator (16) and the compression mechanism (20). The refrigerant in the refrigerant circuit is sucked from the accumulator (16) through suction pipes (14*a*, 14*b*) into the compression mechanism (20).

A discharge pipe (15) vertically penetrating the upper end plate (12) is attached to the casing (10). A lower end of the discharge pipe (15) is open in the interior of the casing (10). A discharge port (not shown) of the compression mechanism (20) communicates with the internal space of the casing (10) through the discharge openings (44*a*) of the muffler (44), and the refrigerant discharged from the compression mechanism (20) flows out of the casing (10) through the internal space of the casing (10) and the discharge pipe (15).

The internal space of the casing (10) is divided into a first space (S1) and a second space (S2) which are located one above the other with the electric motor (30) interposed therebetween. In this embodiment, the first space (S1) is located below the electric motor (30), and the second space (S2) is located above the electric motor (30). The compression mechanism (20) is disposed in the first space (S1).

As shown in FIG. 1, a partition plate (50) in which a gas passage hole (51) is formed is provided in the second space (S2). The partition plate (50) thus provided can keep pressure waves of a low frequency component that has traveled from the first space (S1) to the second space (S2) from being reflected on the upper end plate (12) and returning to the first space (S1). This can reduce the generation of a standing wave by the pressure wave traveling upward and the pressure wave traveling downward in the casing (10). Thus, the partition plate (50) can reduce pressure pulsation in the casing (10).

Figure 2:
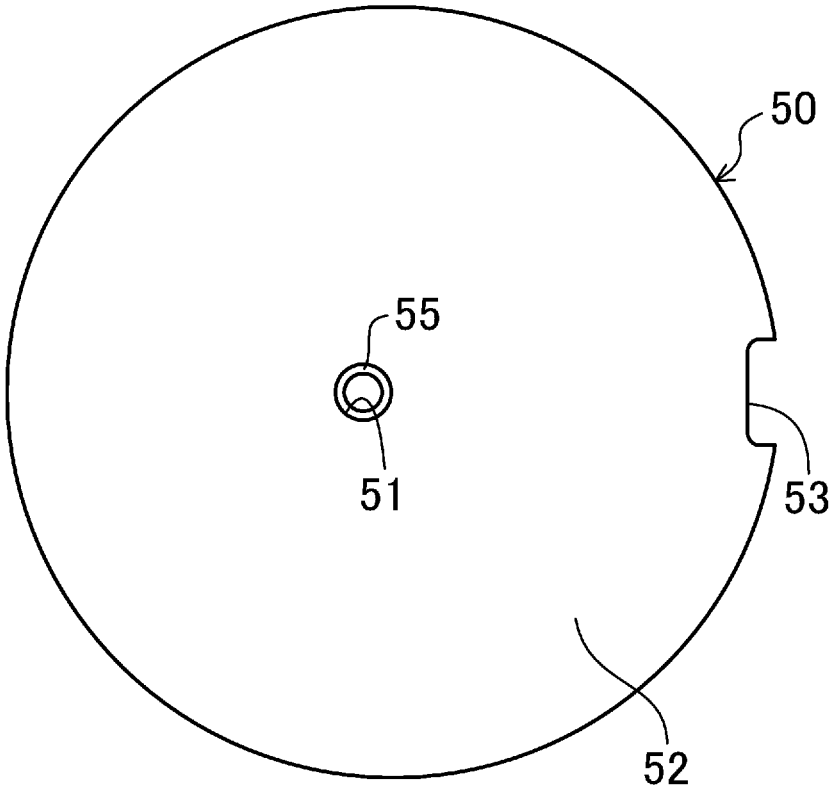
FIG. 2 is a plan view of a partition plate.
Figure 3:
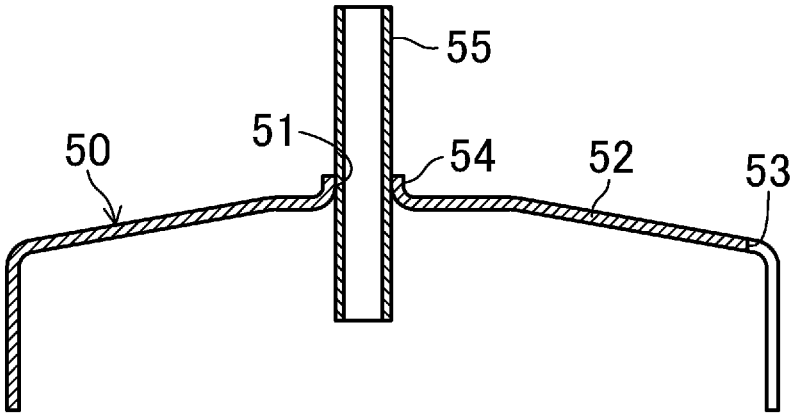
FIG. 3 is a longitudinal sectional view of the partition plate.

FIG. 2 is a plan view of the partition plate (50), and FIG. 3 is a longitudinal sectional view of the partition plate (50). An upper surface of the partition plate (50) is formed as a gently inclined surface (52) which is raised toward its center so that the gas passage hole (51) is formed at a higher level than a peripheral portion of the partition plate. A single oil drain hole (53) is cut in the peripheral portion of the partition plate (50). The oil drain hole (53) is located at a lower level than the open end of the gas passage hole (51). The oil drain hole (53) may be formed at a position slightly inward of an outer peripheral edge of the partition plate (50), in particular, at a position above the stator.

Figure 4:
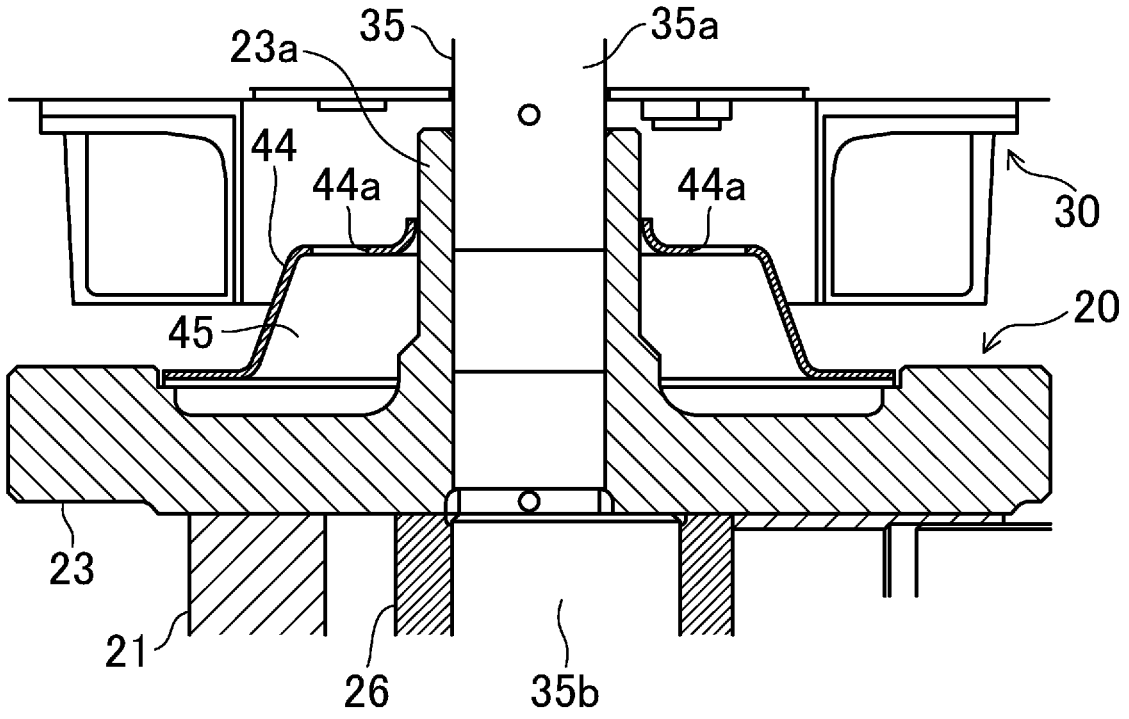
FIG. 4 is a sectional view illustrating a principal part of a compression mechanism.

FIG. 4 is a sectional view illustrating a principal part of the compression mechanism (20). As described above, the muffler (44) having the discharge openings (44*a*) formed in the top thereof is mounted on the front head (23) of the compression mechanism (20).

Figure 5:
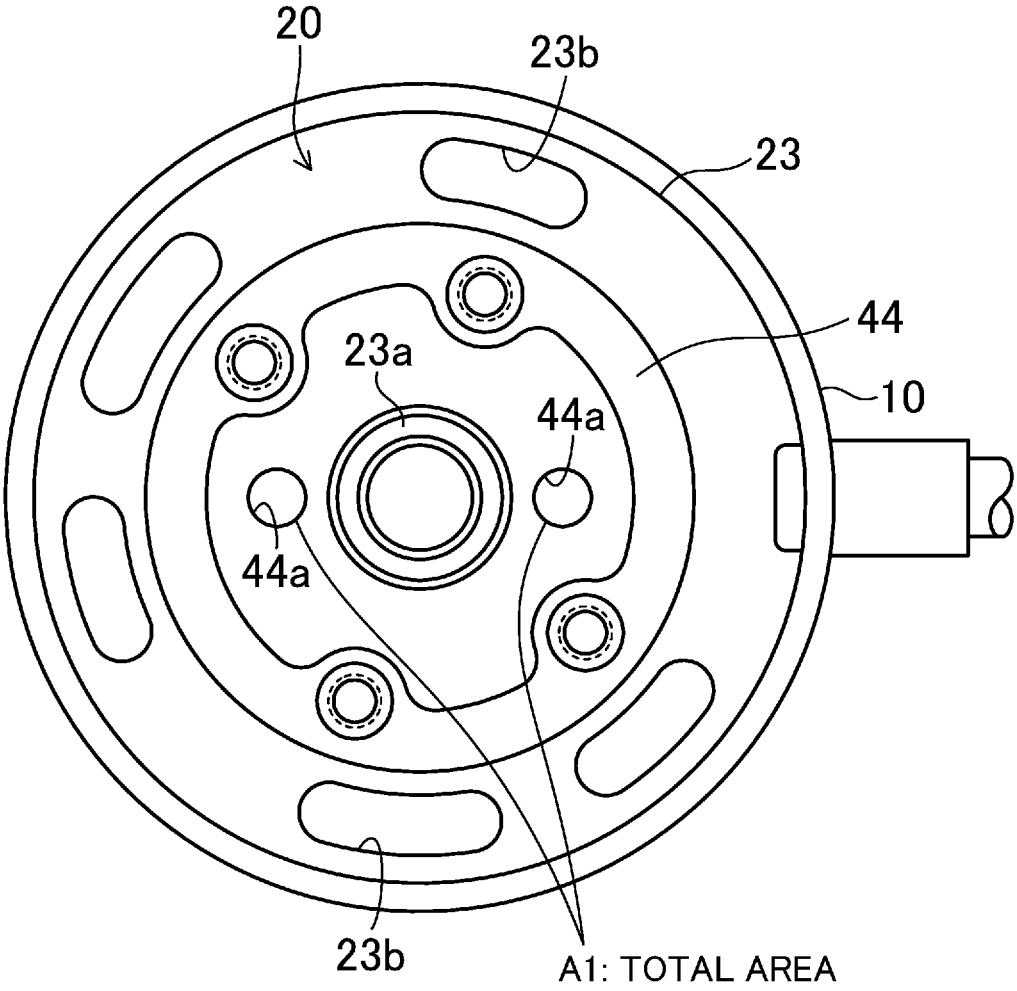
FIG. 5 is a plan view of the compression mechanism.
Figure 6:
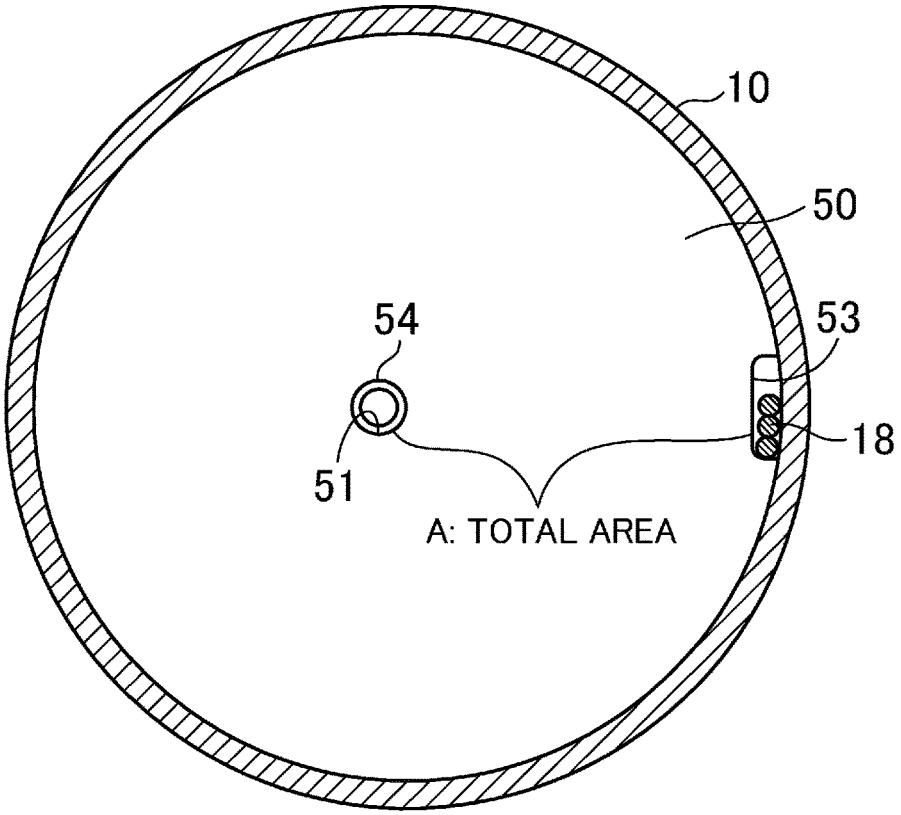
FIG. 6 is a sectional view of a casing taken along a plane above the partition plate, illustrating the partition plate as seen from above.
Figure 7:
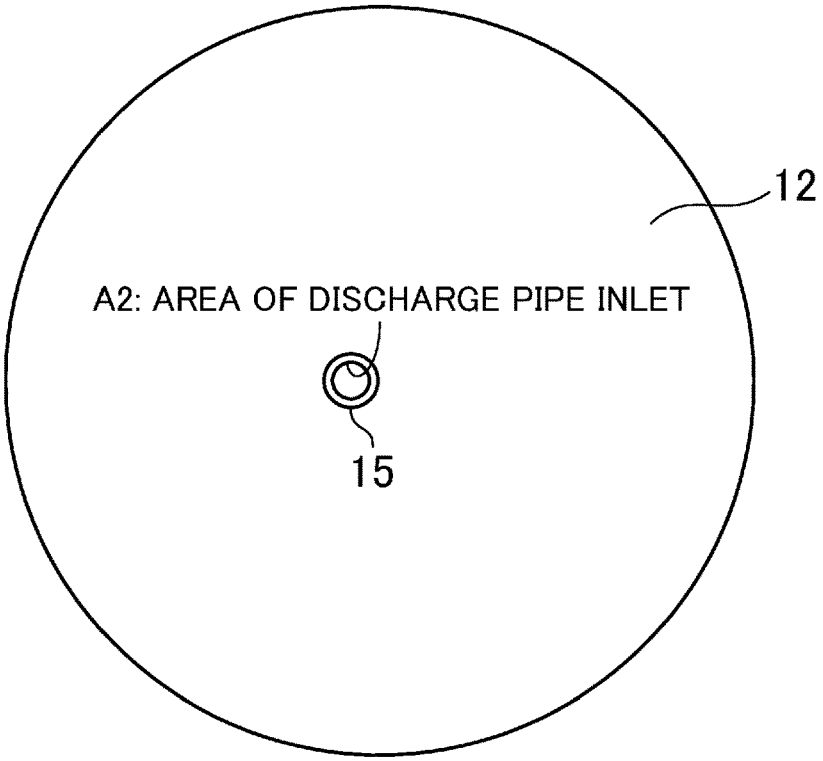
FIG. 7 is a sectional view of the casing taken along a plane above the partition plate, illustrating the casing as seen from below.

FIG. 5 is a plan view of the compression mechanism (20). FIG. 6 is a sectional view of the casing (10) taken along a plane above the partition plate (50) to show the partition plate (50) from above. FIG. 7 is a sectional view of the casing (10) taken along the plane above the partition plate (50) to show the casing (10) from below. In this embodiment, $A2<A<A1$ is satisfied, where A represents the total area of the gas passage hole (51) and the oil drain hole (53), A1 represents the total area of the discharge openings (44*a*) of the discharge muffler (44), and A2 represents the area of an inlet of the discharge pipe (15).

The partition plate (50) has a raised portion (54) formed on the peripheral portion of the gas passage hole (51). In addition, an insertion pipe (55) is inserted in the gas passage hole (51) of the partition plate (50) in a fixed manner so that the insertion pipe (55) is positioned inside the raised portion (54). With the insertion pipe (55) fixed to the partition plate (50), an upper end of the insertion pipe (55) serves as the open end of the gas passage hole (51) in this embodiment.

The upper end of the insertion pipe (55) (i.e., the open end of the gas passage hole (51)) and the lower end of the discharge pipe (15) face each other with a predetermined gap (G) interposed therebetween. Suppose the discharge pipe (15) has an inner diameter d, $G<(d/2)$ is satisfied. The gap (G) and a space around the gap (G) constitute a Helmholtz muffler which is effective for low-frequency vibration (noise) of about 600 Hz or less.

A power supply wire (18) connected to a terminal (17) provided on the top of the casing (10) and the electric motor (30) passes through the oil drain hole (53).

Operation

In this embodiment, when the compressor (1) is operated, a high-pressure gas refrigerant discharged from the compression mechanism (20) flows through the discharge openings (44*a*) of the muffler (44) into the first space (S1). The high pressure gas refrigerant which has flowed into the first space (S1) flows upward through the gap between the stator (31) and rotor (32) of the electric motor (30) as indicated by open arrows in FIG. 1, and then flows outside the compressor (1) through the insertion pipe (55) and the discharge pipe (15).

Part of the gas refrigerant that has flowed upward through the insertion pipe (55) flows into the second space (S2) via the gap between the insertion pipe (55) and the discharge pipe (15) as indicated by solid arrows. Lubricant is separated from the gas refrigerant that has flowed into the second space. Since the partition plate (50) has the inclined surface (52) ascending toward the center and descending toward the peripheral portion, the lubricant flows toward the peripheral portion along the inclined surface (52). The lubricant drops through the oil drain hole (53) cut in the peripheral portion of the partition plate (50), flows downward through a core cut (notch) (31*a*) formed in the outer periphery of the stator (31), and returns to an oil reservoir at the bottom of the casing (10) through an oil drain opening (23*b*) of the front head (23) shown in FIG. 5.

In this embodiment, the partition plate (50) thus provided can reduce the generation of the standing wave by the pressure wave of the low frequency component. In addition, the gap (G) between the insertion pipe (55) and the discharge pipe (15) and the space around the gap (G) function as a Helmholtz muffler, thereby reducing low-frequency pressure pulsation.

Advantages of Embodiment

According to this embodiment, when the lubricant contained in the discharged gas is separated from the refrigerant in the space above the partition plate (50), the lubricant does not accumulate on the surface of the partition plate (50), but drops downward through the oil drain hole (53) cut in the peripheral portion of the partition plate (50). Consequently, the lubricant is less likely to be atomized by the rotation of the rotor (32), and returns to the oil reservoir of the casing (10). Thus, unlike the conventional case, this makes it difficult that the lubricant is discharged outside the compressor (1) while remaining contained in the refrigerant.

If the amount of the lubricant emitted outside the compressor (1) increases, an oil level in the compressor (1) is lowered, which increases the possibility of poor lubrication due to lack of the lubricant fed from the centrifugal pump (36) at the lower end of the drive shaft (35) connected to the electric motor (30) and the compression mechanism (20). If the lubricant emitted outside the compressor (1) flows into a heat exchanger of the refrigerant circuit and adheres to the inner surface of the heat exchanger, the heat exchange performance may be impaired. In contrast, in this embodiment, the emission of the lubricant to the outside of the compressor (1) is reduced. This can reduce the possibilities of the poor lubrication in the compressor (1) and the impairment of the performance of the heat exchanger of the refrigerant circuit to which the compressor (1) is connected.

Further, in this embodiment, the total area A of the gas passage hole (51) and the oil drain hole (53), the total area A1 of the discharge openings (44*a*) of the discharge muffler (44), and the area A2 of the inlet of the discharge pipe (15) are designed to satisfy A2<A<A1. With the decrease in the opening area A of the partition plate (50), the pulsation is further reduced, but simultaneously, the pressure loss increases, and the efficiency decreases. However, in this embodiment, the pulsation can be reduced while the pressure loss is kept from increasing.

In this embodiment, the partition plate (50) is provided with the raised portion (54) and the insertion pipe (55), both of which function as a tail pipe. This can reduce the pressure pulsation of the high-pressure gas refrigerant discharged from the compression mechanism (20) with the help of the effect of resonance caused when the high-pressure refrigerant gas passes through the raised portion (54) and the insertion pipe (55) serving as the tail pipe.

Further, in this embodiment, the gap (G) is defined between the insertion pipe (55) and the discharge pipe (15) such that the gap (G) and the space around the gap (G) function as the Helmholtz muffler. This can reduce the pulsation more effectively.

Moreover, in this embodiment, the wire (18) passes through the oil drain hole (53) cut in the peripheral portion of the partition plate (50). Thus, the lubricant adhering to the wire (18) is less likely to flow toward the rotor (32) in the center portion of the electric motor (30). Therefore, the lubricant is less likely to be atomized by the rotation of the rotor (32). Further, with the wire (18) passing through the oil drain hole (53), the length of the wire (18) connected to the terminal (17) and the electric motor (30) can be made shorter than that in the case where the wire (18) does not pass through the oil drain hole (53).

Variations of Embodiment

<First Variation>

Figure 8:
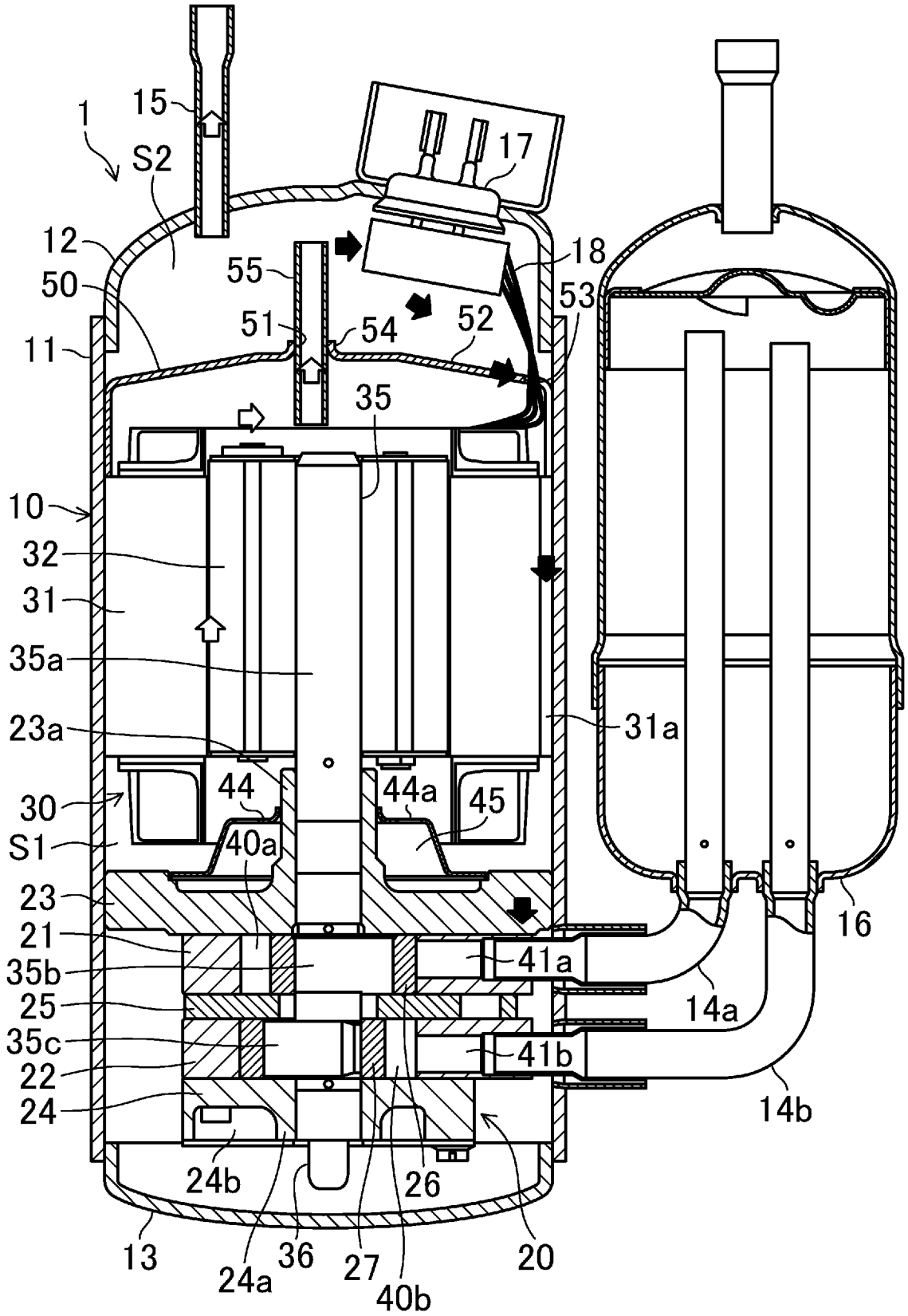
FIG. 8 is a longitudinal sectional view of a compressor according to a first variation of the first embodiment.

FIG. 8 is a longitudinal sectional view of a compressor according to a first variation of the first embodiment.

In the first variation, the center of the insertion pipe (55) provided in the gas passage hole (54) and the center of the discharge pipe (15) are out of alignment with each other. The configuration of the first variation is the same as that of the first embodiment shown in FIG. 1 except for this feature.

According to the first variation, since the center of the insertion pipe (55) provided in the gas passage hole (54) and the center of the discharge pipe (15) are out of alignment with each other, the gas flowing out of the insertion pipe (55) is once dispersed in the second space. The lubricant is then separated from the refrigerant in the second space. This makes it difficult that the lubricant is kept contained in the refrigerant and discharged outside the compressor (1) together with the refrigerant.

In the second space (S2), a fast swirling flow is generated in a space below the partition plate (50) by the rotation of the rotor (32). Thus, the centrifugal force significantly facilitates the separation of the lubricant from the refrigerant. On the other hand, in the second space (S2), a space above the partition plate (50) is not easily influenced by the rotation of the rotor (32), and the centrifugal force facilitates, to a small extent, the separation of the lubricant from the refrigerant. Therefore, when the center of the insertion pipe (55) and the center of the discharge pipe (15) are not aligned with each other as in the first variation, it is suitable that an outlet of the space around which the swirling flow is fast (the insertion pipe (55)) is arranged at the center portion of the casing (10), and the discharge pipe (15) is displaced from the center portion of the casing (10). This arrangement makes it difficult for the lubricant to flow outside the compressor (1).

<Second Variation>

Figure 9:
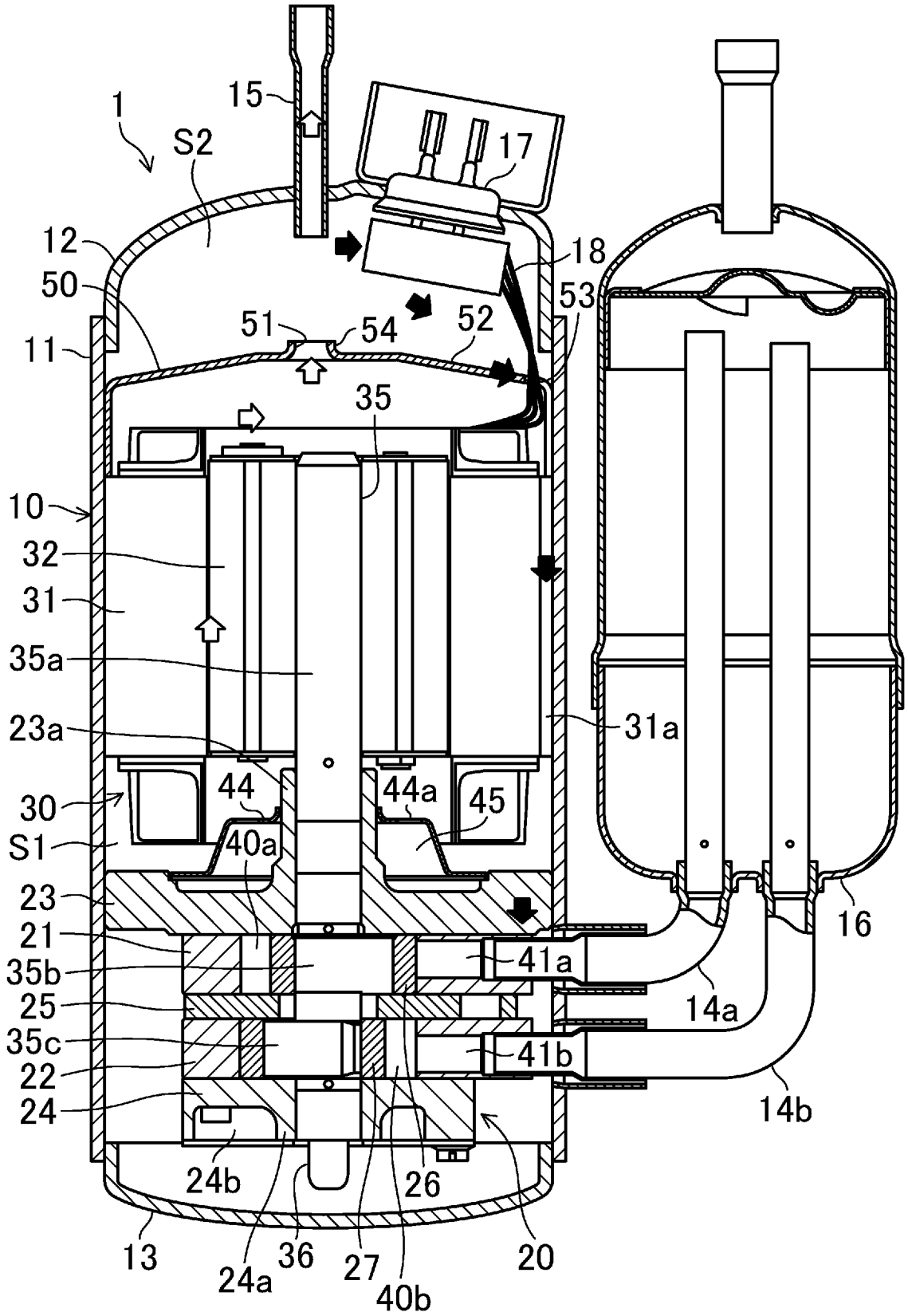
FIG. 9 is a longitudinal sectional view of a compressor according to a second variation of the first embodiment.

FIG. 9 shows an example in which the partition plate (50) has the raised portion (54), but does not have the insertion pipe (55). The configuration of the second variation is the same as that of the first embodiment shown in FIG. 1 except for this feature.

Also in the second variation, the partition plate (50) is provided with the inclined surface (52), and the oil drain hole (53) which is cut in the peripheral portion to be located at a lower level than the open end of the gas passage hole (51). Thus, the lubricant separated from the refrigerant in the space above the partition plate returns to the oil reservoir at the bottom of the casing (10) through the oil drain hole (53) and the core cut (31*a*). Therefore, as compared with the conventional case, the oil level is less likely to be lowered, and the poor lubrication is less likely to occur.

Further, the partition plate (50) makes it difficult for the low frequency component of the discharge gas to generate the standing wave, and the raised portion serving as the tail pipe can reduce the vibration and noise.

In this configuration, if the lower end of the discharge pipe (15) is brought closer to the raised portion (54) so that the gap (G) is formed in the same manner as in the first embodiment, the gap (G) and its surrounding space function as the Helmholtz muffler. This can reduce the pulsation more effectively.

<Third Variation>

Figure 10:
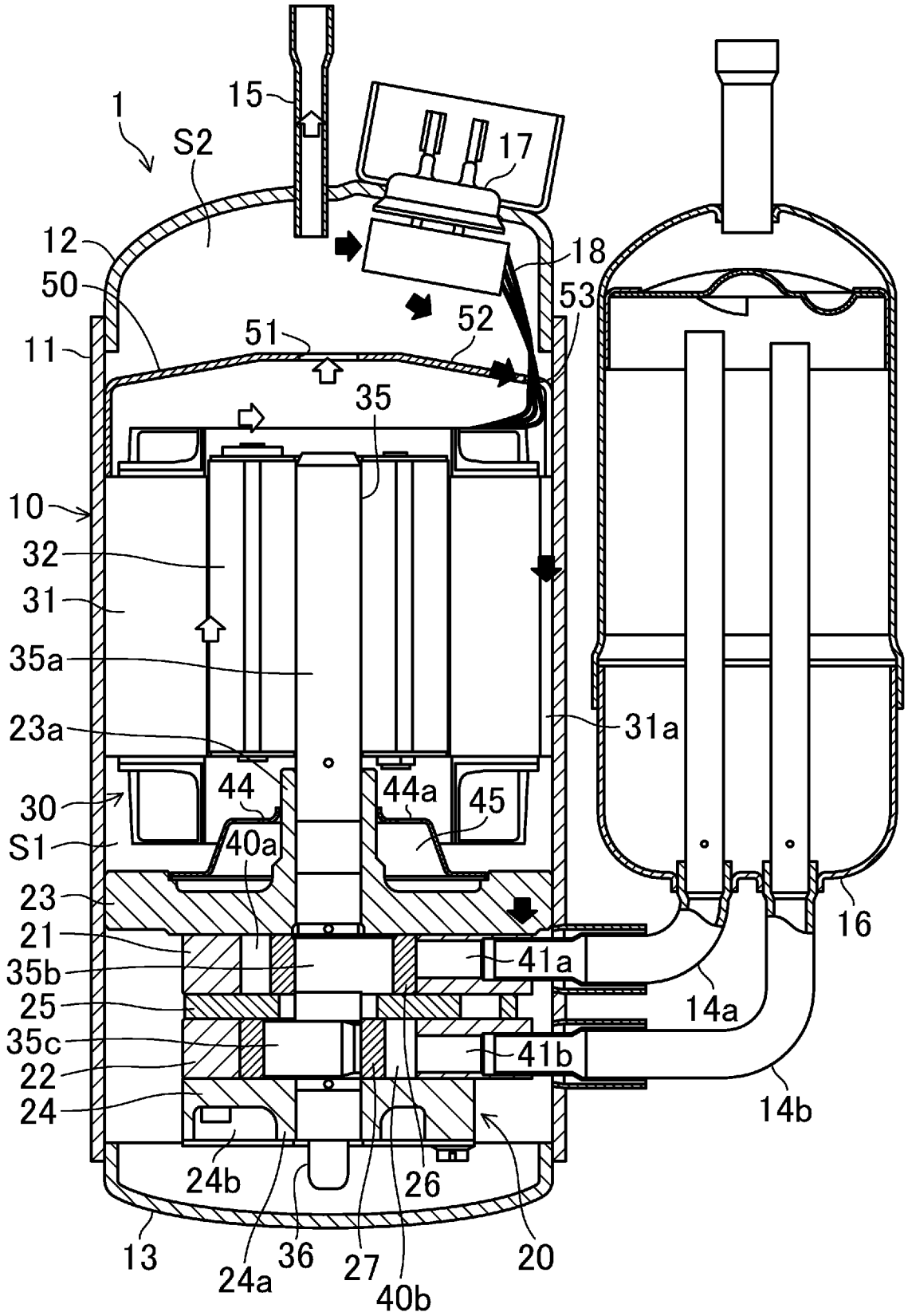
FIG. 10 is a longitudinal sectional view of a compressor according to a third variation of the first embodiment.

FIG. 10 shows an example in which the partition plate (50) has neither the insertion pipe (55) nor the raised portion (54). The configuration of the third variation is the same as that of the first embodiment shown in FIG. 1 except for this feature.

Also in the third variation, the partition plate (50) is provided with the inclined surface (52), and the oil drain hole (53) which is cut in the peripheral portion to be located at a lower level than the open end of the gas passage hole (51). Thus, the lubricant separated from the refrigerant in the space above the partition plate returns to the oil reservoir at the bottom of the casing (10) through the oil drain hole (53) and the core cut (31*a*). Therefore, as compared with the conventional case, the oil level is less likely to be lowered, and the poor lubrication is less likely to occur.

Further, the partition plate (50) makes it difficult for the low frequency component of the discharge gas to generate the standing wave, which can effectively reduce the pulsation.

<Fourth Variation>

Figure 11:
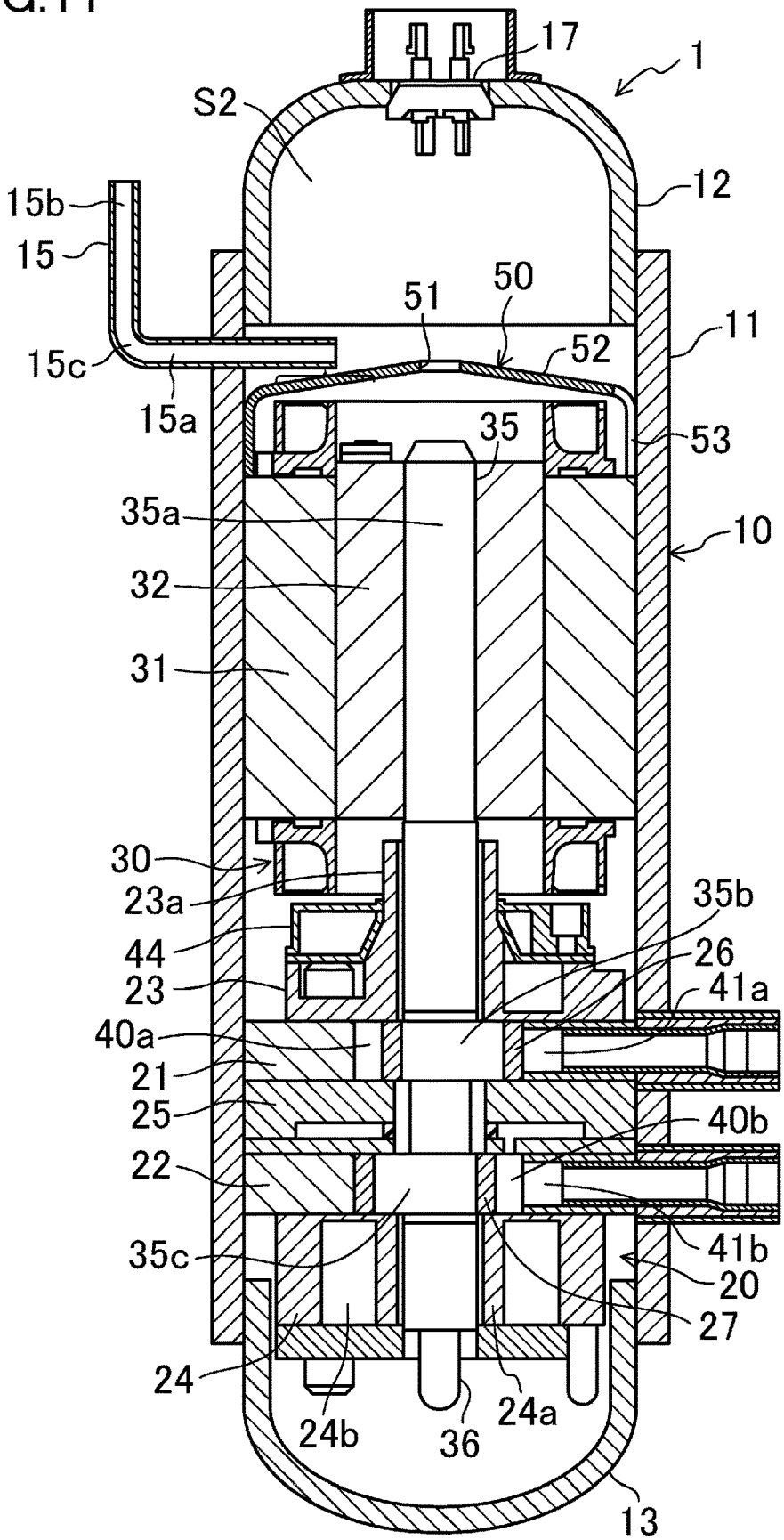
FIG. 11 is a longitudinal sectional view of a compressor according to a fourth variation of the first embodiment.

A compressor according to the fourth variation shown in FIG. 11 compresses carbon dioxide as the refrigerant, and the pressure in the casing is so high to exceed 10 MPa. Therefore, the barrel (11), the upper end plate (12), and the lower end plate (13) of the casing (10) are made thicker than those of the embodiment shown in FIG. 1.

The compressor (1) of the fourth variation is a two-cylinder compressor just like that of the embodiment of FIG. 1. The compressor (1) is a two-stage compressor among the two-cylinder compressors. Although the components of this compressor are slightly different in shape from those of the embodiment shown in FIG. 1, functionally corresponding components are denoted by the same reference characters, and detailed description of such components will not be repeated.

This casing (10) houses a compression mechanism (20) in its lower portion, and an electric motor (30) above the compression mechanism (20). The electric motor (30) is configured in the same manner as that of the above-described embodiment. The compression mechanism (20) is basically configured in the same manner as that of the above-described embodiment except that the refrigerant is compressed in two stages.

Also in the fourth variation, a partition plate (50) having a gas passage hole (51) formed therein is disposed in a second space (S2). An upper surface of the partition plate (50) is formed as a gently inclined surface (52) which is raised toward its center so that the gas passage hole (51) is formed at a higher level than a peripheral portion of the partition plate (50). A single oil drain hole (53) is cut in an outer peripheral portion of the partition plate (50). The oil drain hole (53) is located at a lower level than the open end of the gas passage hole (51). The oil drain hole (53) does not necessarily have to be cut in the outer peripheral edge of the partition plate (50), but may be positioned inward of the outer peripheral edge, more specifically, above the rotor (32).

The compressor (1) of the fourth variation is a compressor (1) using carbon dioxide as a refrigerant as described above, and has a terminal (17) disposed at the center thereof in order to improve the strength of the upper end plate (12). The discharge pipe (15) has an inlet portion (15*a*) from which the discharge gas enters, and an outlet portion (15*b*) from which the discharge gas flows out. The inlet portion (15*a*) is bent at approximately 90° at an elbow-shaped bent (15*c*) with respect to the outlet portion (15*b*). The inlet portion (15*a*) laterally penetrates the barrel (11).

This variation can provide the following advantages in addition to those described in the above-described embodiment.

Specifically, in the case where the partition plate (50) is not provided in the compressor (1) in which the discharge pipe (15) laterally penetrates the casing (10), the rotor (32) of the electric motor (30) and a balance weight (not shown) generate a strong swirling flow. Due to the swirling flow, droplets of the lubricant separated from the gas refrigerant splatter in the direction of the centrifugal force, and are easily emitted outside the compressor through the discharge pipe (15). In contrast, according to the fourth variation, the provision of the partition plate (50) makes it difficult for the swirling flow to be generated in the second space. This reduces the possibility that the droplets of the lubricant are separated from the gas refrigerant, and splatter toward the wall surface of the barrel (11), thereby keeping the lubricant from easily flowing out of the discharge pipe (15).

As described above, according to the fourth variation, the emission of the lubricant to the outside of the compressor (1) is reduced further easily. This makes it possible to easily achieve a configuration which reduces the possibilities of the poor lubrication in the compressor (1) and the impairment of the performance of the heat exchanger of the refrigerant circuit connected to the compressor (1).

In this variation, an insertion pipe (55) bent at about 90° may be provided in the gas passage hole (51) of the partition plate (50), and the discharge pipe (15) shown in FIG. 11 may be disposed slightly above the illustrated position so that the inlet portion (15*a*) of the discharge pipe (15) and the insertion pipe (55) constitute a Helmholtz muffler.

The compressor (1) of the fourth variation compresses the carbon dioxide refrigerant. However, irrespective of the type of the refrigerant used, a configuration having the discharge pipe (15) laterally penetrating the barrel (11) of the casing (10) advantageously reduces the discharge of the lubricant.

<Fifth Variation>

Figure 12:
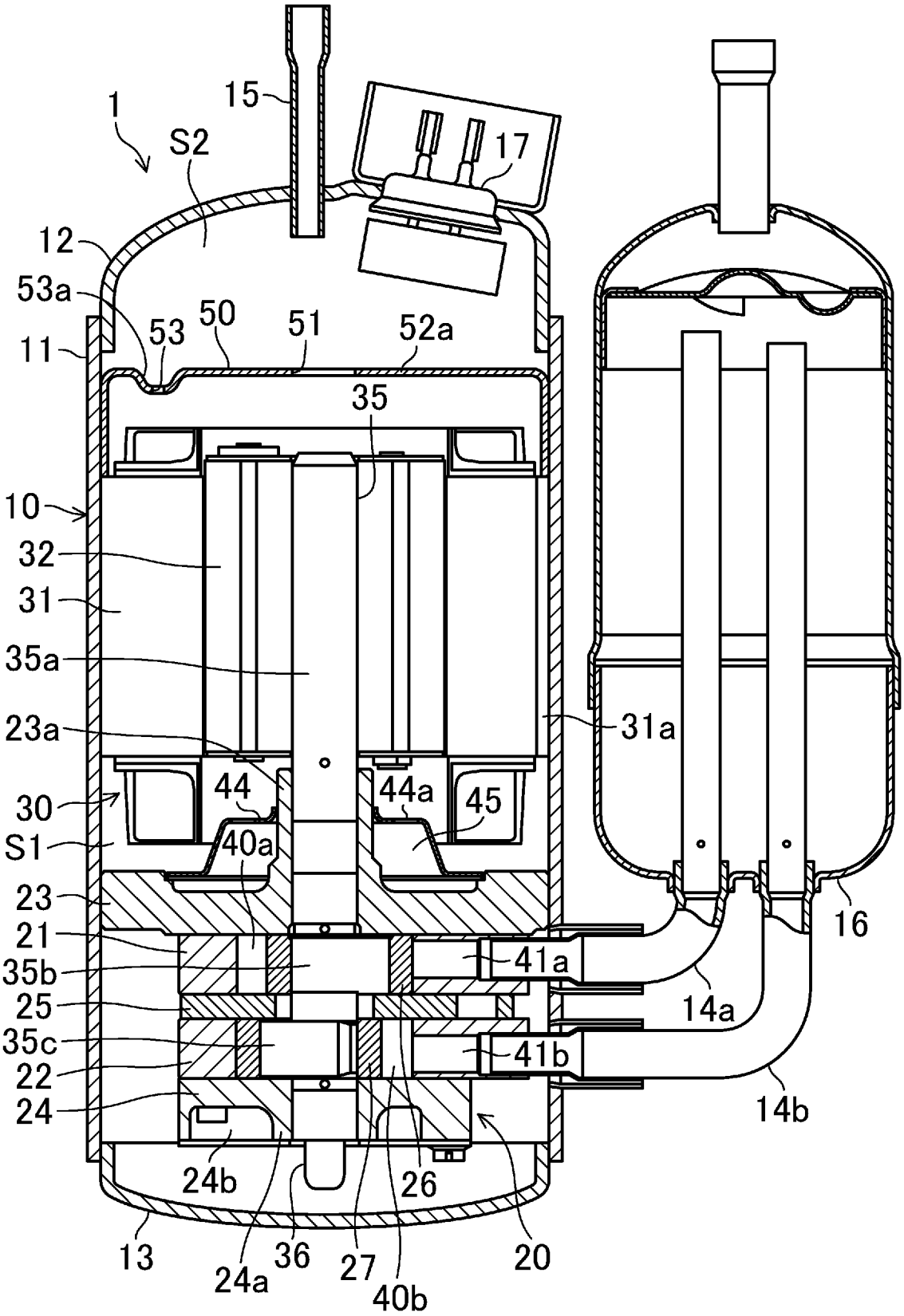
FIG. 12 is a longitudinal sectional view of a compressor according to a fifth variation of the first embodiment.

A compressor (1) of a fifth variation shown in FIG. 12 is configured in the same manner as that of the embodiment shown in FIG. 1 except for the partition plate (50). Therefore, in the fifth variation, only the partition plate (50) will be focused on.

The partition plate (50) of the fifth variation has a flat surface (52*a*) in place of the inclined surface (52) shown in FIG. 1. The partition plate (50) has an oil drain hole (53) positioned above the stator (31) of the electric motor (30). The oil drain hole (53) is cut in the bottom of a recess (53*a*) which is provided slightly inward of an outer peripheral edge of the flat surface (52*a*). Thus, the oil drain hole (53) is located at a lower level than the open end of the gas passage hole (51) formed in the center of the partition plate (50).

As is apparent from the fifth variation, the oil drain hole (53) does not necessarily have to be cut in the outer peripheral edge of the partition plate, but may be positioned inward of the outer peripheral edge. In this variation, the oil drain hole (53) is located above the stator (31) of the electric motor (30), i.e., at a position radially outside the outer peripheral surface of the rotor (32) of the electric motor (30). If the oil drain hole (53) was formed in the partition plate (50) to be located above the rotor (32), droplets of the lubricant that have fallen through the oil drain hole would be scattered by the rotor (32). However, with the oil drain hole (53) positioned radially outside the outer peripheral surface of the rotor (32), the droplets, if fallen through the oil drain hole, are not scattered by the rotor (32). Thus, the oil drain hole (53) does not necessarily have to be cut in the outer peripheral edge of the partition plate (50), as long as the oil drain hole (53) is positioned radially outside the outer peripheral surface of the rotor (32).

Also in the fifth variation, the partition plate (50) thus provided can reduce the vibration and noise caused by the generation of the standing wave, and in addition, can reduce the emission of the lubricant to the outside of the compressor (1). This can reduce the possibilities of the poor lubrication in the compressor (1) and the impairment of the performance of the heat exchanger of the refrigerant circuit connected to the compressor (1).

OTHER EMBODIMENTS

The above-described embodiment may be modified as follows.

For example, it has been described in the embodiment that the present disclosure is applied to a two-cylinder swing piston compressor, as an example. However, the present disclosure is applicable to a compressor of any type provided that a compression mechanism is disposed in a first space of a casing below an electric motor and a partition plate is disposed in a second space located above the electric motor and provided with a discharge pipe.

Further, it has been described in the embodiment that the total area A of the gas passage hole (51) and the oil drain hole (53), the area A1 of the discharge openings (44*a*) of the discharge muffler (44), and the area A2 of the inlet of the discharge pipe (15) are set to satisfy a particular relationship (A2<A<A1). However, they may satisfy a different relationship. In addition, the wire (18) does not have to pass through the oil drain hole (53).

It should be noted that the embodiments described above are merely exemplary ones in nature, and do not intend to limit the scope of the present disclosure or applications or use thereof.

As described above, the present disclosure is useful for a compressor having a partition plate that reduces the generation of a standing wave by a low frequency component in a casing, thereby reducing vibration and noise.

What is claimed is:

1. A compressor comprising:

a compression mechanism configured to compress gas and discharge the compressed gas;

an electric motor arranged to drive the compression mechanism;

a casing housing the compression mechanism and the electric motor;

a suction pipe connected to a suction side of the compression mechanism via the casing; and a discharge pipe provided at the casing so as to open in a space in the casing, the space in the casing having a first space located below the electric motor, and a second space located above the electric motor, the compression mechanism being disposed in the first space, the compressor being provided with a partition plate disposed in the second space, and the partition plate having a gas passage hole formed therein, the partition plate further having an oil drain hole formed at a lower level than an open end of the gas passage hole, and the oil drain hole being located at an outer peripheral edge of the partition plate and radially outside an outer peripheral surface of a rotor of the electric motor, the gas passage hole and the oil drain hole extending through the partition plate in an axial direction.

2. The compressor of claim 1, wherein a discharge muffler having a discharge opening is attached to the compression mechanism, and A2<A<A1 is satisfied where A represents a total area of the gas passage hole and the oil drain hole, A1 represents an area of the discharge opening of the discharge muffler, and A2 represents an area of an inlet of the discharge pipe.

3. The compressor according to claim 1, wherein the partition plate has a raised portion formed on a peripheral portion of the gas passage hole.

4. The compressor of claim 1, wherein an insertion pipe is provided in the gas passage hole.

5. The compressor of claim 1, wherein the open end of the gas passage hole and a lower end of the discharge pipe face each other with a predetermined gap interposed therebetween, and the predetermined gap between the open end of the gas passage hole and the lower end of the discharge pipe and a space around the predetermined gap constitute a Helmholtz muffler.

6. The compressor of claim 1, wherein a power supply wire is connected to a terminal provided on a top of the casing and to the electric motor, the power supply wire passing through the oil drain hole.

7. The compressor of claim 1, wherein a center of the gas passage hole and a center of the discharge pipe are out of alignment with each other.

8. The compressor of claim 1, wherein the discharge pipe vertically penetrates an upper end plate of the casing, which is in a shape of a vertically-oriented cylinder.

9. The compressor of claim 1, wherein the discharge pipe laterally penetrates a barrel of the casing, which is in a shape of a vertically-oriented cylinder.

10. The compressor according to claim 2, wherein the partition plate has a raised portion formed on a peripheral portion of the gas passage hole.

11. The compressor of claim 2, wherein an insertion pipe is provided in the gas passage hole.

12. The compressor of claim 2, wherein the open end of the gas passage hole and a lower end of the discharge pipe face each other with a predetermined gap interposed therebetween, and the predetermined gap between the open end of the gas passage hole and the lower end of the discharge pipe and a space around the predetermined gap constitute a Helmholtz muffler.

13. The compressor of claim 2, wherein a power supply wire is connected to a terminal provided on a top of the casing and to the electric motor, the power supply wire passing through the oil drain hole.

14. The compressor of claim 2, wherein a center of the gas passage hole and a center of the discharge pipe are out of alignment with each other.

15. The compressor of claim 2, wherein the discharge pipe vertically penetrates an upper end plate of the casing, which is in a shape of a vertically-oriented cylinder.

16. The compressor of claim 2, wherein the discharge pipe laterally penetrates a barrel of the casing, which is in a shape of a vertically-oriented cylinder.

* * * * *